US007896091B2

(12) United States Patent
Williamson et al.

(10) Patent No.: US 7,896,091 B2
(45) **Date of Patent: *Mar. 1, 2011**

(54) CONVERTIBLE SEAL

(75) Inventors: Scott E. Williamson, Castle Rock, CO (US); John W. McKeachnie, Vernal, UT (US)

(73) Assignee: Weatherford/Lamb, Inc., Houston, TX (US)

( * ) Notice: Subject to any disclaimer, the term of this patent is extended or adjusted under 35 U.S.C. 154(b) by 6 days.

This patent is subject to a terminal disclaimer.

(21) Appl. No.: 12/412,650

(22) Filed: Mar. 27, 2009

(65) Prior Publication Data

US 2009/0178808 A1 Jul. 16, 2009

Related U.S. Application Data

(63) Continuation of application No. 11/623,141, filed on Jan. 15, 2007, now Pat. No. 7,510,018.

(51) Int. Cl.
*E21B 33/12* (2006.01)
*E21B 34/06* (2006.01)

(52) U.S. Cl. ..... 166/387; 166/133; 166/188; 166/317; 166/325

(58) Field of Classification Search ..... 166/387, 166/133, 188, 317, 325
See application file for complete search history.

(56) References Cited

U.S. PATENT DOCUMENTS 3,086,591 A * 4/1963 Sexton ..... 166/151
3,211,228 A * 10/1965 Bramlett ..... 166/128
4,313,497 A * 2/1982 Graham ..... 166/124
4,478,279 A * 10/1984 Puntar et al. ..... 166/121
5,062,481 A * 11/1991 Gullett ..... 166/153
6,257,339 B1 * 7/2001 Haugen et al. ..... 166/387
6,612,372 B1 * 9/2003 Freiheit et al. ..... 166/387
7,117,949 B2 * 10/2006 Doane et al. ..... 166/380
7,510,018 B2 * 3/2009 Williamson et al. ..... 166/387
2004/0003928 A1 * 1/2004 Frazier ..... 166/387
2004/0216868 A1 * 11/2004 Owen, Sr. ..... 166/134
2004/0216871 A1 * 11/2004 Mendez et al. ..... 166/187
2004/0244966 A1 * 12/2004 Zimmerman et al. ..... 166/118
2006/0124296 A1 * 6/2006 Erkol ..... 166/242.7
2006/0131031 A1 * 6/2006 McKeachnie et al. ..... 166/376

FOREIGN PATENT DOCUMENTS

EP 1172521 * 7/2002
EP 1384850 * 10/2006

* cited by examiner

*Primary Examiner*—Hoang Dang
(74) *Attorney, Agent, or Firm*—Patterson & Sheridan, LLP

(57) ABSTRACT

A method and apparatus for sealing a wellbore is described herein. A convertible seal includes a sealing element and a valve. The sealing element is in fluid communication with the valve and fluidly blocks a bore of the convertible seal. The sealing element prevents fluid from flowing through the bore until desired. When desired, the sealing element is removed to allow fluid to flow through the bore. Fluid flow in the bore is controlled by the valve. As a result, the convertible seal has been converted to a flow control seal.

27 Claims, 5 Drawing Sheets

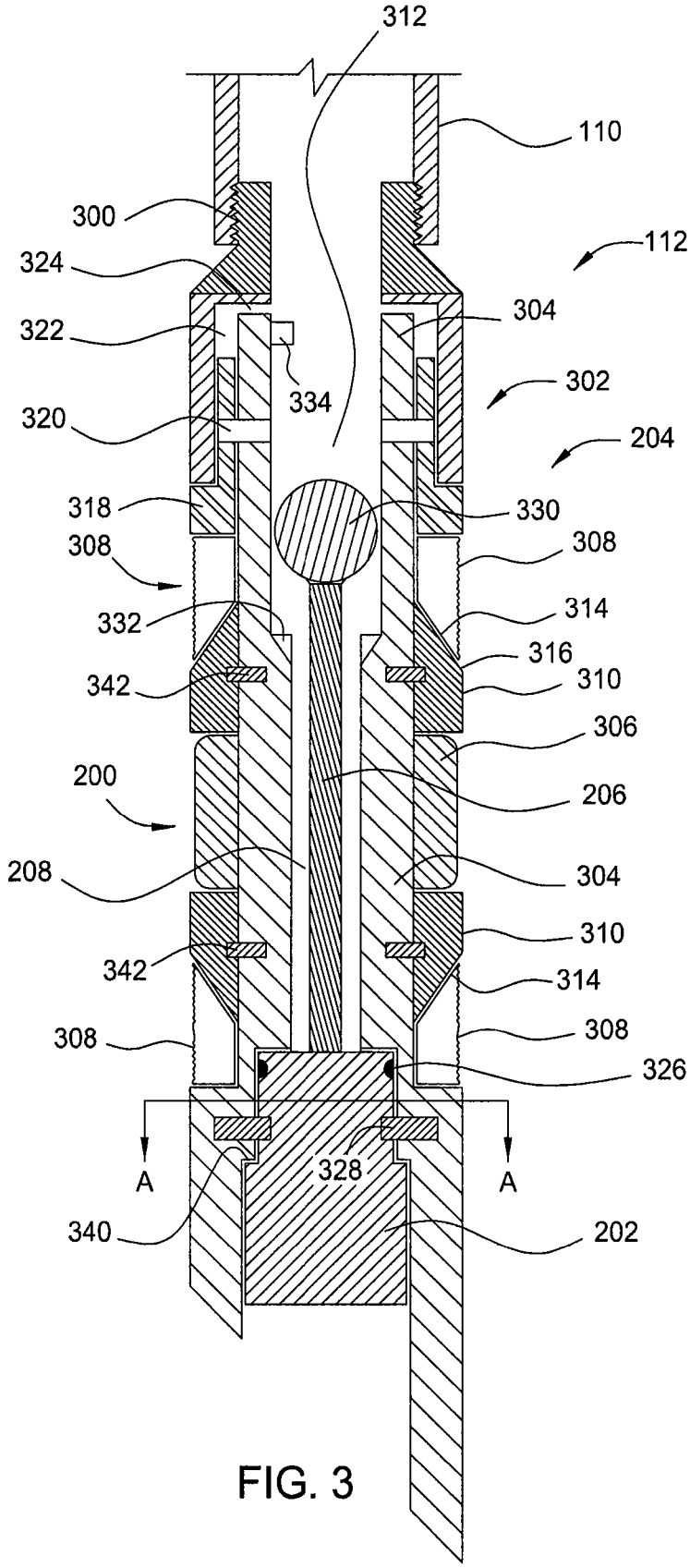
FIG. 3
FIG. 3A
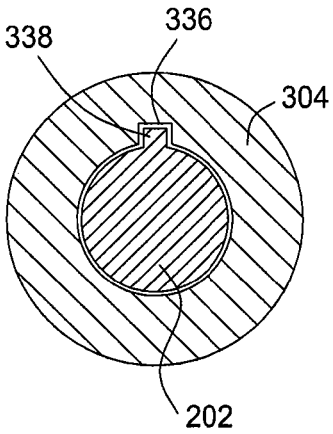

CONVERTIBLE SEAL

CROSS-REFERENCE TO RELATED APPLICATIONS

This application is a continuation of U.S. patent application Ser. No. 11/623,141, filed Jan. 15, 2007, now U.S. Pat. No. 7,510,018, which is herein incorporated by reference in its entirety.

BACKGROUND OF THE INVENTION

1. Field of the Invention

Embodiments of the present invention generally relate to a method and apparatus for selectively sealing the wellbore. More particularly, the apparatus relates to a seal that is convertible to a flow control seal. More particularly still, the apparatus relates to a seal having a plug and a valve, the valve being held in an open position upon run in and setting of the seal. More particularly still, the apparatus relates to a seal having a plug and a valve, the plug is removed when desired to allow the valve to control flow through the seal.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the wellbore. A cementing operation is then conducted in order to fill the annular area with cement. The combination of cement and casing strengthens the wellbore and facilitates the isolation of certain areas of the formation behind the casing for the production of hydrocarbons.

There are various downhole operations in which it may become necessary to isolate particular zones within the well. This is typically accomplished by temporarily plugging off the well casing at a given point or points with a bridge plug. Bridge plugs are particularly useful in accomplishing operations such as isolating perforations in one portion of a well from perforations in another portion or for isolating the bottom of a well from a wellhead. The purpose of the plug is simply to isolate some portion of the well from another portion of the well. Bridge plugs do not allow flow past the plug in either direction. In order to reestablish flow past a bridge plug an operator must remove and/or destroy the bridge plug by milling, drilling, or dissolving the bridge plug.

During a fracturing or stimulation operation of a production zone, it is often necessary to seal the production zone from wellbore fluids while allowing production fluids to travel up the wellbore and past the seal. Frac plugs are designed to act as a seal and to provide a fluid path therethrough. Frac plugs typically have a one way valve which prevents fluids from flowing downhole while allowing fluids to flow uphole. In operation, a frac plug is installed above the zone that has been fractured (frac'd) or treated. This seals the treated zone from the uphole wellbore fluids while allowing any production fluids to flow through the frac plug. After the frac plug is set, an operator may treat an uphole zone without interfering with the previously treated downhole zone. Once the uphole zone is treated, a second frac plug may be set above it. This process may be repeated until all, or a select number, of the production zones in the wellbore have been treated.

In some instances, it may be desirable to seal a treated lower zone from flow in both directions while treating an upper zone. In particular, it is often desirable to reduce the wellbore pressure above the pressure-charged treated lower zone by setting a pressure isolation device and then bleeding off wellbore pressure at the surface. This is desirable for safety reasons as well as providing a negative pressure test on the plug, which is set above the treated zone. This is not possible using a frac plug. Instead, this requires setting a bridge plug above the treated zone. The pressure above the bridge plug is then bled off. The upper zone may then be treated while flow to the lower zone is prevented. After the upper zone has been treated, the bridge plug is removed and a frac plug is set in its place. The removal of the bridge plug and setting of the frac plug generally requires separate trips downhole. Each trip adds to the expense of the operation. Further, the time required to set the frac plug after the bridge plug is removed may cause damage to the lower zone due to wellbore pressure entering the treated zone.

There is a need, therefore, for a bridge plug which can be converted to a frac plug. There is a further need for the bridge plug to have a valve which is mechanically held in the open position until the bridge plug is converted to a frac plug.

SUMMARY OF THE INVENTION

Embodiments described herein relate to a convertible seal. The convertible seal may be for use in a wellbore. The convertible seal may have a seal element for sealing the interior of the wellbore and a fluid path through the sealing element. Further, the convertible seal may include a removable plug configured to block fluid communication through the fluid path and a valve in fluid communication with the fluid path. In addition, the convertible seal may include an activator configured to hold the valve in an open position while the removable plug blocks the fluid path.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3 is a cross sectional view of a convertible seal according to one embodiment described herein.

FIG. 3A is a cross sectional view of an end of the convertible seal according to one embodiment described herein.

DETAILED DESCRIPTION

Figure 1:
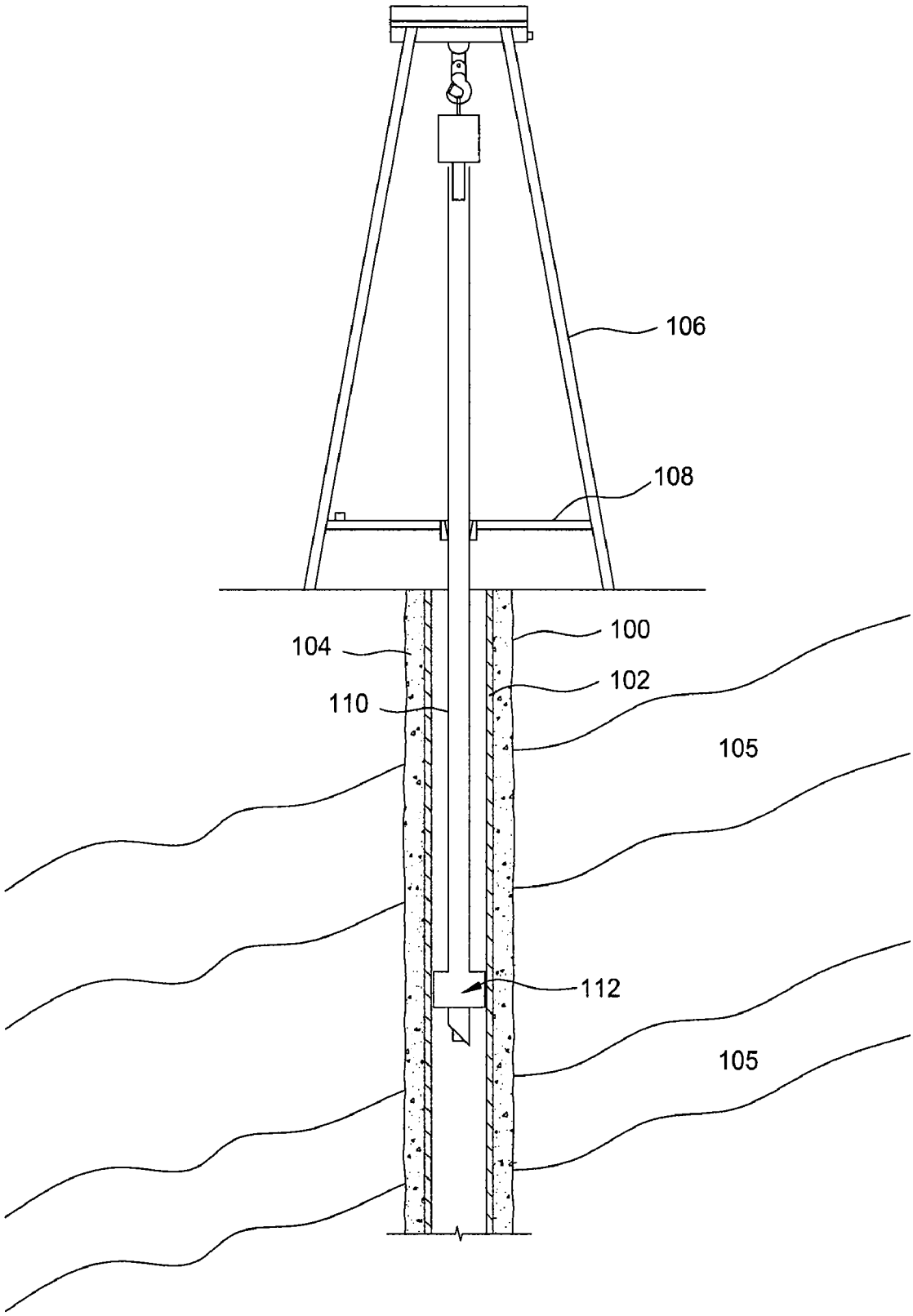
FIG. 1 is a schematic view of a wellbore having a convertible seal according to one embodiment described herein.

FIG. 1 is a schematic view of a wellbore 100 according to one embodiment described herein. The wellbore 100 includes a tubular 102 having an annulus 104 between the wellbore and the tubular 102. The tubular 102, as shown, is a casing; however, it should be appreciated that the tubular 102 could be any downhole tubular such as, but not limited to, a liner, a production tubing, or a drill string. The annulus 104, as shown, is filled with cement; however, it should be appreciated that cementing is not required and that other means for isolating the wellbore 100 may be used, such as expanding the casing into the wellbore and external packers.

Although shown as having a casing, it should be appreciated that the wellbore may be an open hole wellbore.

The wellbore 100 intersects at least one production zone 105. A rig 106 having a rig floor 108 is located at the surface. The rig 106 may be used to form a conveyance 110 and, thereafter, run the conveyance 110 into the wellbore 100. The conveyance 110, as shown, is a jointed pipe which is formed by coupling pipe stands together at the surface, then lowering each pipe stand into the wellbore 100 and attaching a subsequent pipe. Although shown as a jointed pipe, it should be appreciated that the conveyance 110 may be any conveyance for running tools, for example a production tubing, a drill string, a casing, coiled tubing, a co-rod, a wire line, or a slick line. It is contemplated that the conveyance 110 may be run in by other methods, for instance by winding and unwinding a spool with a conveyance such as coiled tubing, wire line, slick line, or rope.

The conveyance 110 is shown running a convertible seal 112 into the wellbore 100. The convertible seal 112 is adapted to set inside the tubular 102 or uncased wellbore and seal the interior diameter of the tubular 102. Initially upon setting of the convertible seal 112, the tubular 102 is sealed from flow past the convertible seal 112 in either up-hole flow or down-hole flow direction. When desired, the convertible seal 112 may be converted to allow controllable flow, as described in more detail below.

Figure 2:
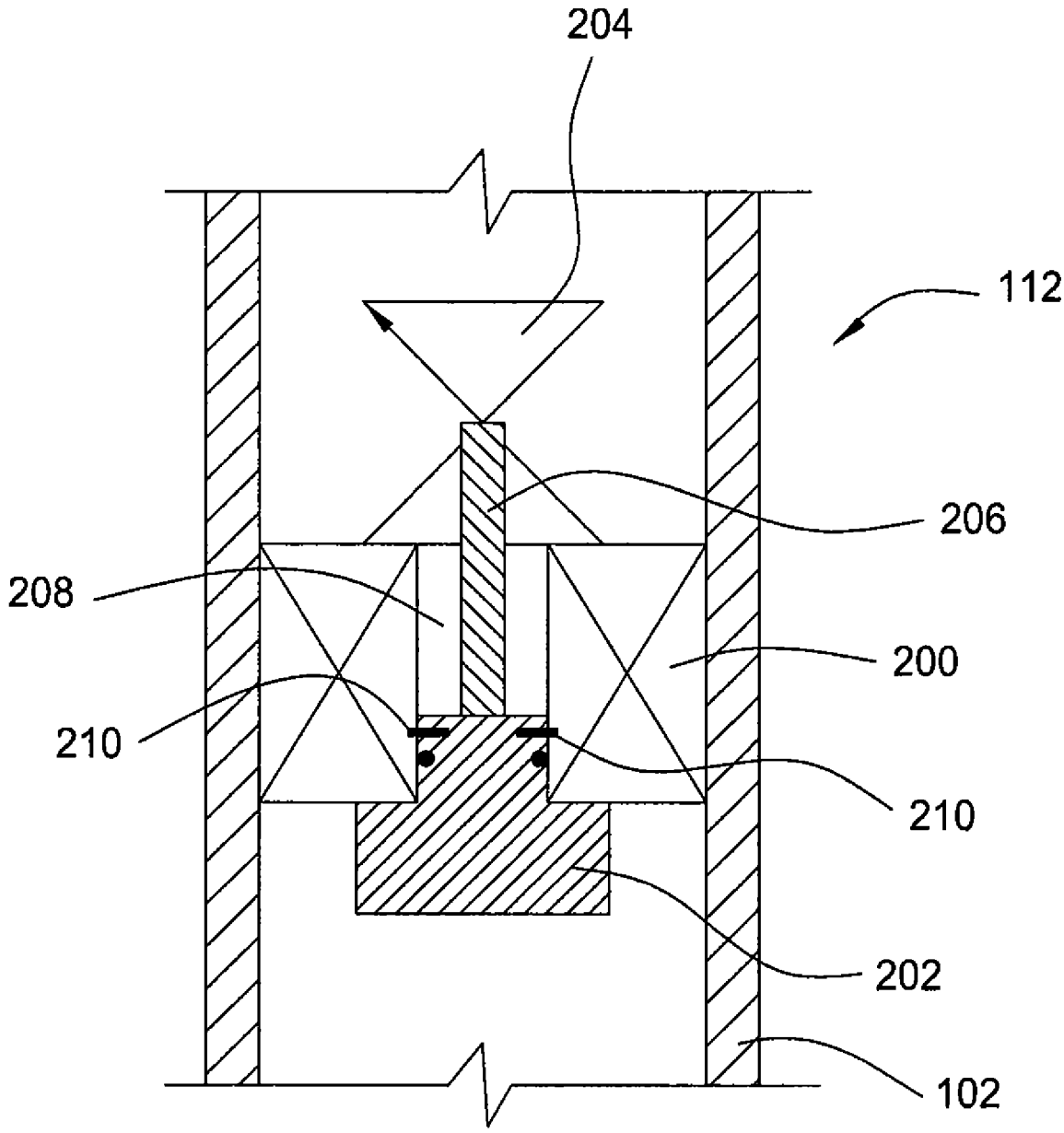
FIG. 2 is a schematic view of a convertible seal according to one embodiment described herein.

FIG. 2 is a schematic view of the convertible seal 112 in sealing engagement with the tubular 102. The convertible seal 112 may be used initially as a bi-directional seal and later converted to a unidirectional flow control seal. The convertible seal 112 includes a seal 200, a plug 202, a valve 204, and an activator 206. The seal 200 has a flow path 208 which transverses the seal 200. The seal 200 is configured to fluidly seal the interior diameter of the tubular 102. The plug 202 is configured to block the flow path 208 from fluid communication. The plug 202 is operatively coupled to a lower portion of the seal 200 using one or more selectively releasable pins 210. Although shown as pins 210, any device for temporarily coupling the plug 202 to the seal 200 may be used, including but not limited to a collet, a shearable ring. The valve 204 positioned at an upper portion of the seal 202 is in fluid communication with the flow path 208. The valve 204 may be held in the open position by the activator 206 until the plug 202 is removed from the flow path 208. After the plug 202 is removed and the activator 206 is no longer holding the valve 204 in the open position, the valve 204 may be operated to control fluid flow past the seal 200, as will be described in more detail below. Thus, the convertible seal 112 may be run into a wellbore 100 and set at the desired location. The set convertible seal 112 seals bi-directional fluid flow in the wellbore 100. Thereafter, the plug 202 may be removed and the valve 204 used to control fluid flow.

FIG. 3 is a cross sectional view of the convertible seal 112 coupled to the conveyance 110, according to one embodiment. In addition to the valve 204, the seal 200, the activator 206, and the plug 202, the convertible seal 112 includes a connector portion 300, an actuator 302, and a mandrel 304. The connector portion 300 is adapted for coupling the convertible seal 112 to the conveyance 110. As shown, the connector portion 300 is a threaded connection; however, it should be appreciated that any suitable connection for coupling the convertible seal 112 to the conveyance 110 may be used.

The seal 200, as shown in FIG. 3, is a packer having a sealing element 306 and one or more gripping members 308. The sealing element 306 is an annular member disposed around the mandrel 304 and between two wedge blocks 310. The wedge blocks may be used to compress the sealing element 306, thereby forcing the sealing element 306 to expand radially outward and into engagement with the tubular 102, as will be discussed in more detail below. The sealing element 306 may have any number of configurations to effectively seal the annulus created between the mandrel 304 and a tubular 102. The sealing element 306 may include grooves, ridges, indentations, or protrusions designed to allow the sealing element 306 to conform to variations in the shape of the interior of the tubular 102. The sealing element 306 may be constructed of any expandable or otherwise malleable material which creates a set position and stabilizes the mandrel 304 relative to the tubular 102. For example, the sealing element 306 may be a metal, a plastic, an elastomer, or a combination thereof. Further, the sealing element 306 may be an inflatable sealing member.

The gripping members 308 as shown in FIG. 3 are slips; however, it should be appreciated that the gripping members 308 may be any device adapted to engage the interior of the tubular. Alternatively, the gripping member may be absent and the sealing element is adapted to grip the tubular 102. The gripping members 308 have an angled surface 314 adapted to engage a corresponding angled surface 316 of the wedge block 310. As the gripping members move, the angled surface 314 and the corresponding angled surface 316 interact to move the gripping members 308 radially away from the longitudinal axis of the convertible seal 112. The radial movement causes the gripping members 308 to engage and grip the tubular 102.

The actuator 302 may include a setting piston 318 adapted to move the slips in the longitudinal direction. The setting piston 318 has a shear pin 320 which holds the piston 318 in place until the packer is to be set. Force is delivered to the actuator 302 via an electric line setting tool, a hydraulic setting tool or is mechanically applied. The actuator 302 exerts a force on the piston 318. When the force is greater than the force required to shear the shear pin 320, the shear pin 320 is sheared and the piston 318 moves in order to operate the packer. It should be appreciated that the actuator may be any actuator capable of setting the seal 200 in the tubular 102.

The plug 202, as shown, is adapted to seal the bore 312 of the convertible seal 112 until the plug 202 is removed. The plug 202 has a seal-ring 326 adapted to fluidly seal any space between the mandrel 304 and the plug 202. The plug 202 further includes one or more shear pins 328 to hold the plug 202 in place until it is desired to remove the plug 202. Although shown as one or more shear pins 328 any device for temporarily holding the plug 202 may be used including, but not limited to, a collet and/or a shearable ring. The plug 202 may be any material capable of containing fluid pressure, including but not limited to, metal, plastic, composite, or cement. It should be appreciated that the plug 202 may be any structure which seals the bore 312 and the flow path 208 and is capable of being removed once in the wellbore.

The activator 206 is adapted to hold the valve 204 in the open position until the plug 202 is removed. In one embodiment, the activator 206 is coupled to the plug 202 such that removal of the plug 202 will deactivate the activator 206, thereby allowing the valve 204 to close. As shown, the activator 206 is a rod that is used to keep the valve 204 open. The rod is supported on the plug 202 and extends through and out of the flow path 208. The activator 206 may be any structure capable of keeping the valve 204 open. The activator 206 may be made of any material including, but not limited to, metal, composite, plastic, an elastomer, a cement, or any combination thereof. The activator 206 is shown as a rigid member; however, it should be appreciated that it could be a flexible member or a biasing member such as a spring.

The valve 204 may be a one way ball valve having a ball 330 and a ball seat 332. The activator 206 holds the ball 330 off of the ball seat 332 until the plug 202 is removed. After the plug 202 is removed, the ball 330 is free to engage the ball seat 332 thereby sealing the flow path 208. The valve 204 is adapted to seal the flow path 208 when the pressure above the valve 204 is greater than the pressure below the valve 204. A stopper 334 may be used to prevent the ball 330 from traveling up and out of the convertible seal 112, but the stopper 334 should not significantly impede flow of fluid in the bore 312. Although shown as a ball valve, it should be appreciated that the valve 204 may be any suitable valve capable of remaining open until the plug 202 is removed and then acting as a one-way valve. Further, the valve may be any valve including, but not limited to, a one-way valve, a flapper valve, a counterbalanced valve, or a poppet/seat-style valve.

FIG. 3A is a cross sectional view of the plug 202 and the mandrel 304 at line A-A. The mandrel 304 may include a profile 336 configured to receive a protrusion 338 of the plug 202. The profile 336 and the protrusion 338 are optional and are adapted to inhibit the plug 202 from sealingly re-entering the mandrel 304 once the plug 202 has been removed. That is, when the plug 202 is released from the mandrel 304 it slides or is forcefully expelled past a shoulder 340, and the protrusion 338 disengages the profile 336. In order for the plug 202 to sealingly re-enter mandrel 304, the protrusion 338 and the profile 336 would have to be in alignment with one another. Therefore, even with the introduction of fluid pressure below the plug 202, it is unlikely that the plug 202 will sealingly re-engage the mandrel 304. The protrusion 338 may take any form so long as it assists in preventing the plug 202 from re-entering the mandrel 304. Some alternative designs of the protrusion 338, and/or the profile 336, include, but are not limited to, a biased member, such as a leaf spring, or an elastomeric, which expands once the plug 202 is past the shoulder 340.

Figure 4:
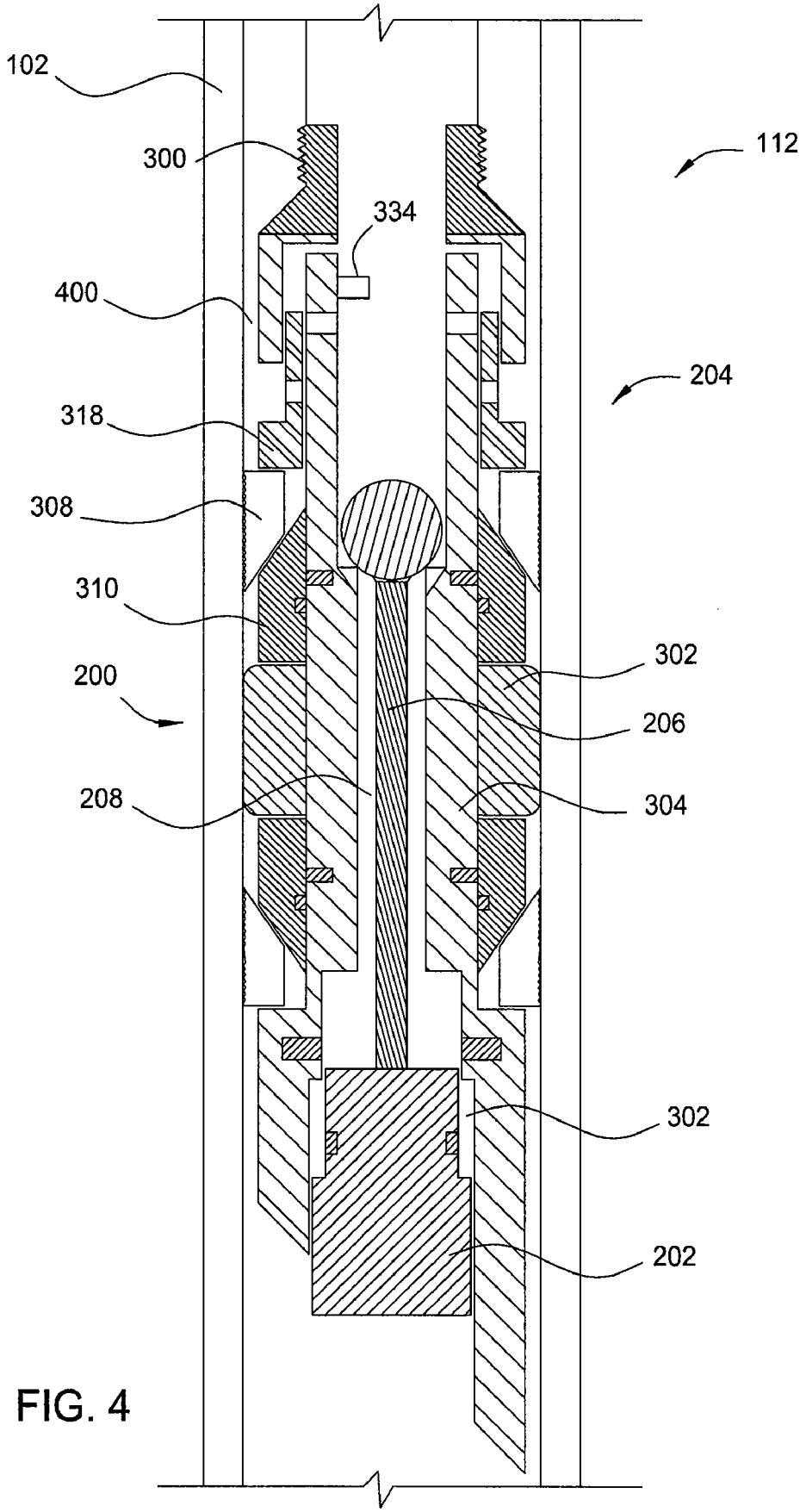
FIG. 4 is a cross sectional view of a convertible seal according to one embodiment described herein.

In operation, the convertible seal 112 is run into the wellbore 100 on the conveyance 110. A fracturing or treatment operation may be performed below the convertible seal 112. The actuator 302 shears the shear pins 320 to release the piston 318. The piston 318 then moves in response to the actuator 302. The piston 318 urges the gripping member 308 against the wedge blocks 310. As the gripping member 308 moves, a third set of shear pins 342 holding the wedge blocks 310 in place is sheared. The upper wedge blocks 310 then move into contact with the sealing element 306. The sealing element 306 pushes against the lower wedge block 310 and the shear pin 342 for the lower wedge block 310 is sheared. The lower wedge block 310 then engages the lower gripping member 308 thereby forcing it radially outward. As the piston 318 continues to move under pressure, the wedge blocks 310 move the gripping members 308 into engagement with the tubular 102, as shown in FIG. 4. The wedge blocks 310 also compress the sealing element 306, thereby forcing the sealing element 306 into sealing engagement with the tubular 102. In this respect, the annulus 400 between the convertible seal 112 and the tubular 102 is sealed from fluid flow in both directions. Further, the plug 202 prevents fluid from flowing past the convertible seal 112 through the fluid path 208. In this configuration, the convertible seal 112 acts as a bridge plug.

Figure 5:
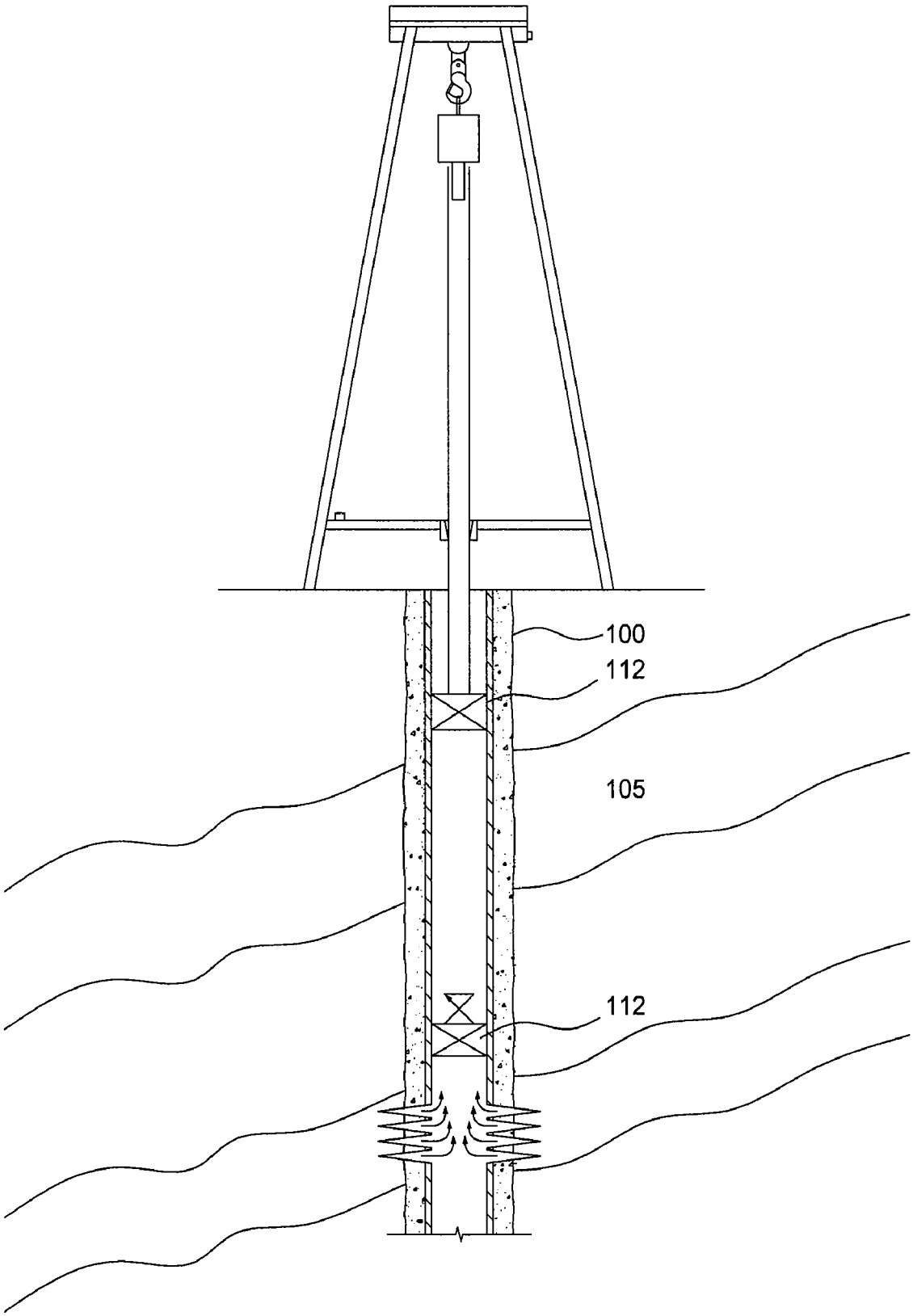
FIG. 5 is a schematic view of a wellbore having a convertible seal according to one embodiment described herein.

The convertible seal 112 may remain in the tubular 102 as a bridge plug until desired. The conveyance 110 may be removed and operations may be performed uphole of the convertible seal 112. When it is desired to convert the convertible seal 112, fluid pressure is increased above the convertible seal 112. The increased fluid pressure enters the fluid path 208 past the valve 204, which is held open by the activator 206, and exerts a force on the top surface of the plug 202. The fluid pressure is increased until the shear pins 328 are sheared. The plug 202 is then free to move in response to the fluid pressure. The plug 202 is forced down by the fluid pressure force until it is clear of the shoulder 340. As the plug 202 moves down, the activator 206 also moves down, thereby allowing the ball 330 to move down. With the plug 202 clear of the shoulder 340, fluid may pass the plug 202 before the valve 204 is closed. The ball 330 eventually lands on the ball seat 332 and further fluid pressure applied up-hole of the convertible seal 112 keeps the valve 204 in the closed position. The convertible seal 112 now operates like a frac plug. That is, the valve 204 of the convertible seal 112 prevents wellbore fluids that are uphole of the convertible seal 112 to flow past the valve 204. However, if the fluid pressure below the convertible seal 112 is greater than the fluid pressure above the convertible seal 112, the valve 204 allows the higher pressure fluid to pass up through the valve 204. The plug 202 may be prevented from moving back into sealing engagement with the mandrel 304 due to the improbability that the plug 202 will align with the mandrel 304 above the shoulder 340 and/or through use of the protrusion 338. Any number of convertible seals 112 may be used in one wellbore 100 as shown in FIG. 5.

In an alternative embodiment, the activator 206 is a biased member, such as a spring or an elastomer. The biasing member may have a minimum fixed length. At the minimum fixed length the biasing member will prevent the valve 204 from closing when the plug 202 is fixed in the mandrel 304. The biasing member functions to extend the plug 202 beyond the end of the mandrel 304 once the plug 202 is sheared, thereby eliminating possible re-engagement and sealing of the plug 202. With the plug 202 sheared from the mandrel, and the valve 204 in the closed position, the activator 206 will bias the plug 202 beyond the shoulder 340, thereby ensuring that the plug 202 does not reseal the mandrel 304. Further, it is contemplated that a spring or plug biasing member may be used independently of the activator in order to expel the plug 202 from the mandrel 304. In this instance the plug biasing member may exert less force on the plug than is required to shear the plug 202 from the mandrel 304. Once the plug 202 is free from the mandrel, the plug biasing member exerts sufficient force to expel the plug 202 from the mandrel 304.

In yet another alternative embodiment, any location requiring a restricted flow path to be converted to a controllable flow path at some time in the future may use a two valve seal. In this embodiment, a mechanical member, for example a rod, holds two valves apart thereby preventing both valves from being closed at the same time. Thus, a first valve is initially in the closed position and the mechanical member is preventing the second valve from closing. A force is then applied to the first valve in order to open the first valve. The force may be the result of fluid pressure, mechanical pressure, or electric actuation. With the first valve open, the mechanical member no longer prevents the second valve from closing. Thus, the second valve is now free to control flow in the valve.

The embodiments described herein are not limited to use in a wellbore. The embodiments described herein may be used at any flow control location, including, but not limited to, piping systems, pipelines, tubing, etc.

While the foregoing is directed to embodiments of the present invention, other and further embodiments of the invention may be devised without departing from the basic scope thereof, and the scope thereof is determined by the claims that follow.

The invention claimed is:

1. A method for sealing a wellbore, comprising:

running a seal into a wellbore on a tubular string, wherein the seal includes a flow path disposed therethrough;

actuating the seal into sealing engagement with the wellbore, thereby preventing fluid from flowing past the seal;

converting the seal into a unidirectional valve by applying a fluid pressure to the seal to open fluid communication through the flow path; and flowing fluid through the flow path in a first direction while preventing fluid flow in a second direction.

2. The method of claim 1, wherein the seal includes a plug operable to prevent fluid communication through the flow path.

3. The method of claim 2, further comprising applying a fluid pressure to the plug to remove the plug from the flow path.

4. The method of claim 3, wherein the unidirectional valve includes a ball and seat arrangement.

5. The method of claim 1, wherein the flow path is sealed while the seal is actuated into engagement with the wellbore.

6. The method of claim 1, further comprising perforating the wellbore above the seal to recover hydrocarbons from a reservoir adjacent the wellbore.

7. The method of claim 6, further comprising using wellbore fluids from below the seal to recover the hydrocarbons.

8. The method of claim 7, further comprising flowing the wellbore fluids through the flow path in the first direction while preventing flow of the wellbore fluids in the second direction.

9. The method of claim 1, wherein the tubular string includes a plurality of seals and further comprising converting the plurality of seals into unidirectional valves.

10. An apparatus for controlling fluid flow in a wellbore, comprising:

a mandrel having a flow path disposed therethrough;

a packer coupled to the mandrel and configured to seal an annulus between the mandrel and the wellbore;

a valve coupled to the mandrel, wherein the valve is configured to allow fluid flow through the flow path in a first direction while preventing flow in a second direction upon activation of the valve; and a selectively removable seal coupled to the mandrel and configured to close fluid communication through the flow path.

11. The apparatus of claim 10, further comprising an activator coupled to the removable seal and operable to retain the valve in an open position.

12. The apparatus of claim 11, wherein the valve includes a ball and seat arrangement.

13. The apparatus of claim 12, wherein the activator includes a rod configured to prevent a ball from resting on a ball seat to retain the valve in the open position.

14. The apparatus of claim 10, wherein the activator includes a biasing member.

15. The apparatus of claim 10, further comprising a shear device coupled to the removable seal and configured to release the seal at a predetermined pressure.

16. The apparatus of claim 10, wherein the removable seal comprises a plug.

17. The apparatus of claim 16, wherein the removable seal comprises a profile adapted to prevent entry of the seal into the mandrel after it has been removed.

18. The apparatus of claim 10, wherein the packer includes a sealing element, a gripping member, and an actuator configured to actuate the sealing element and the gripping member into engagement with the wellbore.

19. A method for sealing a wellbore, comprising:

running a seal into a wellbore on a tubular string, wherein the seal includes a flow path disposed therethrough;

actuating the seal into sealing engagement with the wellbore, thereby preventing fluid from flowing past the seal, wherein the flow path is sealed while the seal is actuated into engagement with the wellbore;

converting the seal into a unidirectional valve; and flowing fluid through the flow path in a first direction while preventing fluid flow in a second direction.

20. The method of claim 19, wherein converting the seal into the unidirectional valve includes applying a fluid pressure to the seal to open fluid communication through the flow path.

21. The method of claim 19, wherein the seal includes a plug operable to seal the flow path and thereby prevent fluid communication through the flow path.

22. The method of claim 21, further comprising applying a fluid pressure to the plug to remove the plug from the flow path and thereby convert the seal into the unidirectional valve.

23. The method of claim 19, wherein the unidirectional valve includes a ball and seat arrangement.

24. The method of claim 19, further comprising perforating the wellbore above the seal to recover hydrocarbons from a reservoir adjacent the wellbore.

25. The method of claim 24, further comprising using wellbore fluids from below the seal to recover the hydrocarbons.

26. The method of claim 25, further comprising flowing the wellbore fluids through the flow path in the first direction while preventing flow of the wellbore fluids in the second direction.

27. The method of claim 19, wherein the tubular string includes a plurality of seals and further comprising converting the plurality of seals into unidirectional valves.

* * * * *

UNITED STATES PATENT AND TRADEMARK OFFICE

CERTIFICATE OF CORRECTION

PATENT NO. : 7,896,091 B2
APPLICATION NO. : 12/412650
DATED : March 1, 2011
INVENTOR(S) : Williamson et al.

It is certified that error appears in the above-identified patent and that said Letters Patent is hereby corrected as shown below:

Column 8, Claim 14, Line 4, please delete "10" in insert --11-- therefor.

Signed and Sealed this
Fifth Day of July, 2011

David J. Kappos

David J. Kappos
*Director of the United States Patent and Trademark Office*